US008651706B2

(12) United States Patent
Lee

(10) Patent No.: US 8,651,706 B2
(45) Date of Patent: Feb. 18, 2014

(54) ILLUMINATOR ARRANGEMENT WITH LESS HEAT INTERVENTION

(76) Inventor: Wen-Sung Lee, Taichung (TW)

( * ) Notice: Subject to any disclaimer, the term of this patent is extended or adjusted under 35 U.S.C. 154(b) by 221 days.

(21) Appl. No.: 13/338,270

(22) Filed: Dec. 28, 2011

(65) Prior Publication Data

US 2013/0170217 A1 Jul. 4, 2013

(51) Int. Cl.
*F21V 29/02* (2006.01)

(52) U.S. Cl.
USPC ..... 362/294

(58) Field of Classification Search
USPC ..... 362/294, 296.01, 296.02, 296.05
See application file for complete search history.

(56) References Cited

U.S. PATENT DOCUMENTS

| | | | | |
|---|---|---|---|---|
| 7,841,742 | B2 * | 11/2010 | Freeman et al. | 362/265 |
| 2008/0007955 | A1 * | 1/2008 | Li | 362/294 |
| 2008/0094841 | A1 * | 4/2008 | Dahm | 362/294 |
| 2010/0213808 | A1 * | 8/2010 | Shi | 313/46 |

* cited by examiner

*Primary Examiner* — Anh Mai
*Assistant Examiner* — Brenitra M Lee

(57) ABSTRACT

An illuminator arrangement with less heat intervention includes a reflecting body having a top opening and a bottom opening, a lens assembled above the top opening, an aluminum base assembled at the bottom opening, at least one heat pipe extended from the aluminum base, a light source assembled on the aluminum base, the heat pipe being made of the material which is a good heat conductor. Under this arrangement, the aluminum base could be moved up and down relative to the top opening so that the light source on the aluminum base could move toward the lens or moves away from the lens so as to diffuse light or focus light. Furthermore, the heat pipe dissipates the heat generated by the light source away from the reflecting body.

5 Claims, 11 Drawing Sheets

Central illumination : 100 Lux

Central illumination : 95 Lux

Central illumination : 90 Lux

ILLUMINATOR ARRANGEMENT WITH LESS HEAT INTERVENTION

BACKGROUND OF THE INVENTION

1. Field of the Invention

The present invention relates to an illuminator, and more particularly to an illuminator arrangement with less heat intervention.

2. Description of Related Art

A conventional illuminator includes a reflecting body and an aluminum base. The reflecting body has a top opening and a bottom opening. A cone surface is formed between the top opening and the bottom opening at the reflecting body. A lens is assembled above the top opening The aluminum base is located at the bottom opening. The aluminum base could be moved up and down relative to the bottom opening. The size of the aluminum base is smaller than the size of the bottom opening so that the aluminum base could pass through the bottom opening. A light source is located on the aluminum base and is corresponding to the lens so that the light source could move away from the lens or move toward the lens via the motion of the aluminum base. Under this arrangement, when the light source moves away from the lens until the light source reaches the bottom of the reflecting body, a plurality of light beams from the light source is reflected by the reflecting body and is refracted by the lens. Consequently, the light beams pass through the lens to the air and the light beams are focused by the reflecting body and the lens. When the light source moves toward the lens until the light source reaches the top of the reflecting body, the light beams from the light source are only refracted by the lens. Consequently, the light beams pass through the lens to the air and the light beams are diffused by the lens.

Recently, the LED light source is popularly used in the illuminators. Light emitting efficiency of the LED illuminator is easily influenced by heat, especially under high power of the electric current for a long time, and the result is the unstable color performance and the higher color temperature. In order to dissipate the heat from the conventional illuminator with LED light source, the aluminum base plays an important role. However, the structure of the aluminum base of the conventional illuminator still has two disadvantages as following:

First, a heat-dissipating area of the aluminum base is not large enough to well dissipate the heat from the light source because the size of the aluminum base is limited to be smaller than the size of the bottom opening.

Second, if a manufacture enlarges the size of the aluminum base, an interaction between the aluminum base and the reflecting body limits the moving space of the light source so that the performances of the focusing light and diffusing light are degraded.

The present invention has arisen to mitigate and/or obviate the disadvantages of the conventional. Further benefits and advantages of the present invention will become apparent after a careful reading of the detailed description with appropriate reference to the accompanying drawings.

SUMMARY OF THE INVENTION

The main objective of the present invention is to provide an improved illuminator arrangement.

To achieve the objective, an illuminator arrangement with less heat intervention comprises a reflecting body having a top opening opened at one end thereof and having a bottom opening opened at another end thereof, a lens assembled above the top opening, a cone surface formed between the top opening and the bottom opening at the reflecting body, a receiving space defined between the top opening, the bottom opening and the cone surface, at least one slot opened along the cone surface, an aluminum base assembled at the bottom opening, at least one heat pipe extended from the periphery of the aluminum base, the heat pipe being corresponding to the slot, a light source assembled on the top of the aluminum base and movable in the receiving space, the heat pipe being made of the material which is a good heat conductor. Wherein, the size of the aluminum base is smaller than the size of the bottom opening; the amount of the heat pipe is the same from the amount of the slot such as one slot corresponding to one heat pipe at the receiving body, two slots corresponding to two heat pipes and four slots corresponding to four heat pipes at the receiving body; or the amount of the slots is more than the amount of the heat pipe; at least one spiral slot on the cone surface is opened from the bottom opening to the top opening; the heat pipe of the aluminum base in the receiving space is extended away from the aluminum base horizontally with an adaptive distance, and then the heat pipe is bent toward the bottom of the receiving space with another adaptive distance.

Under this arrangement, the aluminum base could be moved up and down relative to the top opening and the heat pipe could be moved up and down along the slot with the motion of the aluminum base, so that the light source on the aluminum base moves toward the lens or moves away from the lens so as to diffuse light or focus light.

Further benefits and advantages of the present invention will become apparent after a careful reading of the detailed description with appropriate reference to the accompanying drawings.

DETAILED DESCRIPTION OF THE INVENTION

Figure 1:
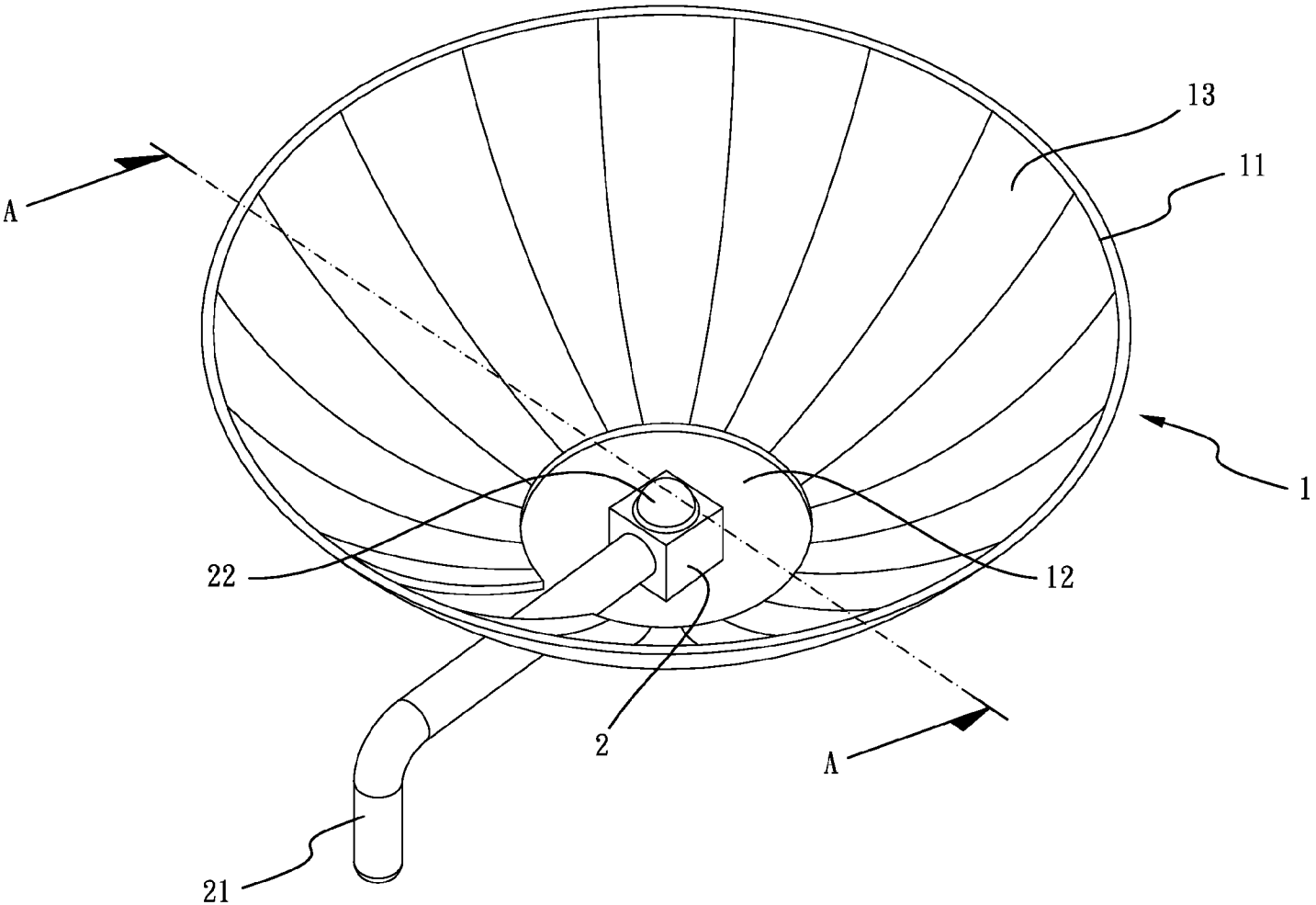
FIG. 1 is a perspective view of an illuminator arrangement with less heat intervention of the present invention.

Referring to FIGS. 1-4, an illuminator arrangement with less heat intervention in accordance with the present invention comprises a reflecting body 1 and an aluminum base 2. The reflecting body 1 has a top opening 11 opened at one end thereof for transmitting the light freely. The reflecting body 1 has a bottom opening 12 opened at another end thereof. A cone surface 13 is formed between the top opening 11 and the bottom opening 12 at the reflecting body 1. A receiving space 14 is defined between the top opening 11, the bottom opening 12 and the cone surface 13. At least one slot 15 is opened along the cone surface 13. One end of the slot 15 is communicated with the bottom opening 12. A lens 3 is assembled above the top opening 11. The aluminum base 2 is assembled at the bottom opening 12. At least one heat pipe 21 is extended from the periphery of the aluminum base 2. The heat pipe 21 is corresponding to the slot 15. The amount of the heat pipe 21 is the same from the amount of the slot 15. A light source 22 is assembled on the top of the aluminum base 2 and is movable in the receiving space 14. The light source 22 is corresponding to the lens 3. The heat pipe 21 is made of the material which is a good heat conductor.

Figure 2:
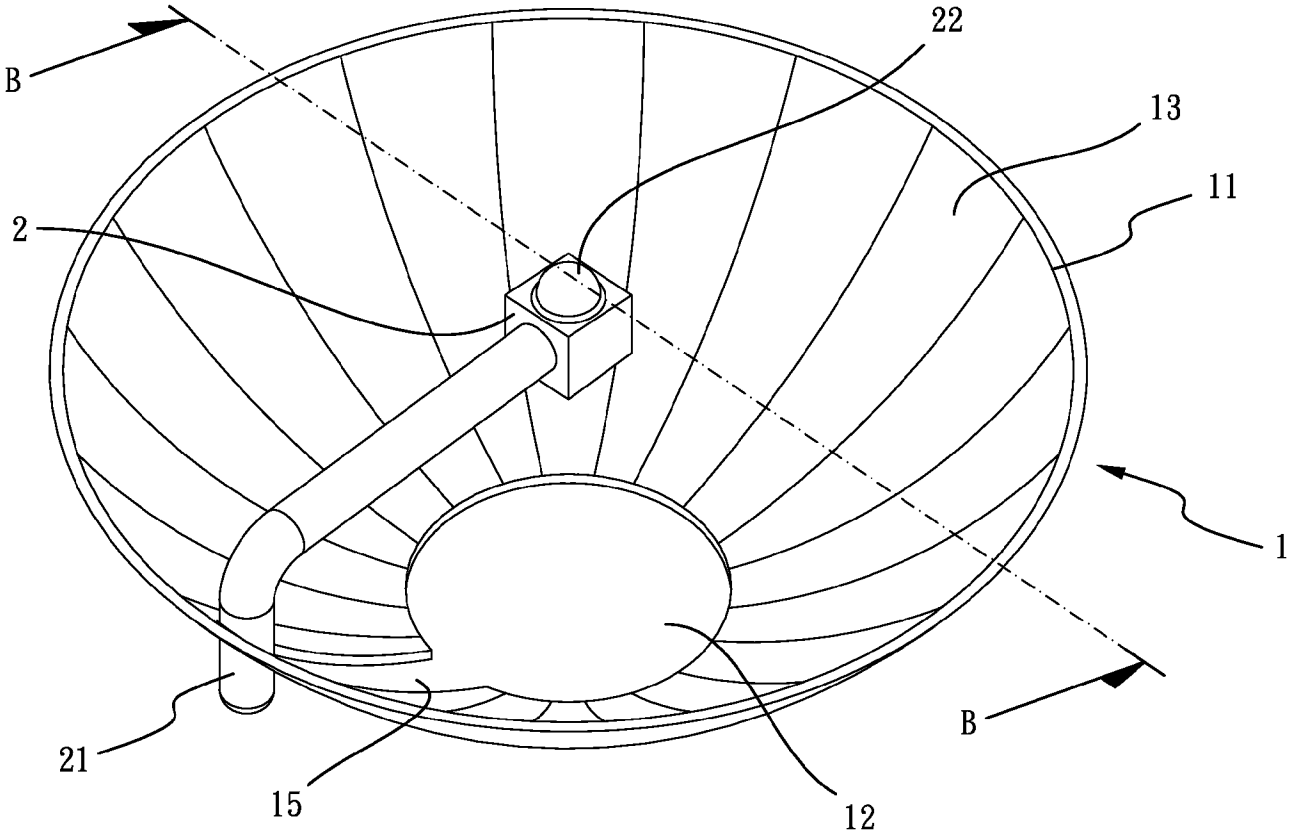
FIG. 2 is a perspective view for showing an aluminum base and a pipe to be moved toward a light emitting opening.

Referring to FIGS. 1-2, the size of the aluminum base 2 is smaller than the size of the bottom opening 12 so that the aluminum base 2 could be moved up and down relative to the top opening 11 and pass through the bottom opening 12. The width of the slot 15 is larger than the diameter of the cross-section of the heat pipe 21 so that the heat pipe 21 could be moved up and down along the slot 15 with the motion of the aluminum base 2. Under this arrangement, the light source 22 on the aluminum base 2 moves toward the lens 3 or moves away from the lens 3 so as to diffuse light or focus light.

Figure 3:
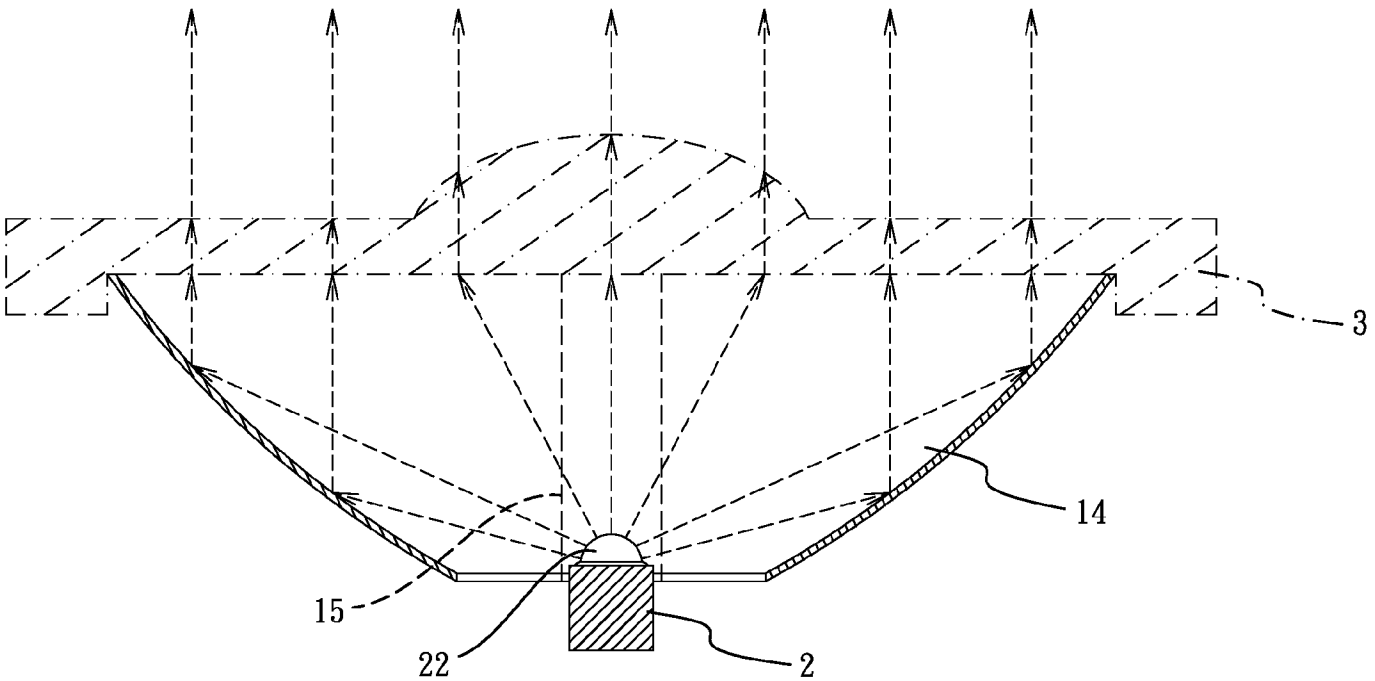
FIG. 3 is a cross-sectional view along a line AA of FIG. 1 for showing a plurality of light beams to be focusing.

Referring to FIG. 3, when the light source 22 moves away from the lens 3 which is above the top opening 11 until the light source 22 reaches the bottom of the receiving space 14, a plurality of light beams from the light source 22 is reflected by the reflecting body 1 and is refracted by the lens 3. Finally, the light beams pass through the lens 3 to the air and the light beams are focused by the reflecting body 1 and the lens 3.

Figure 4:
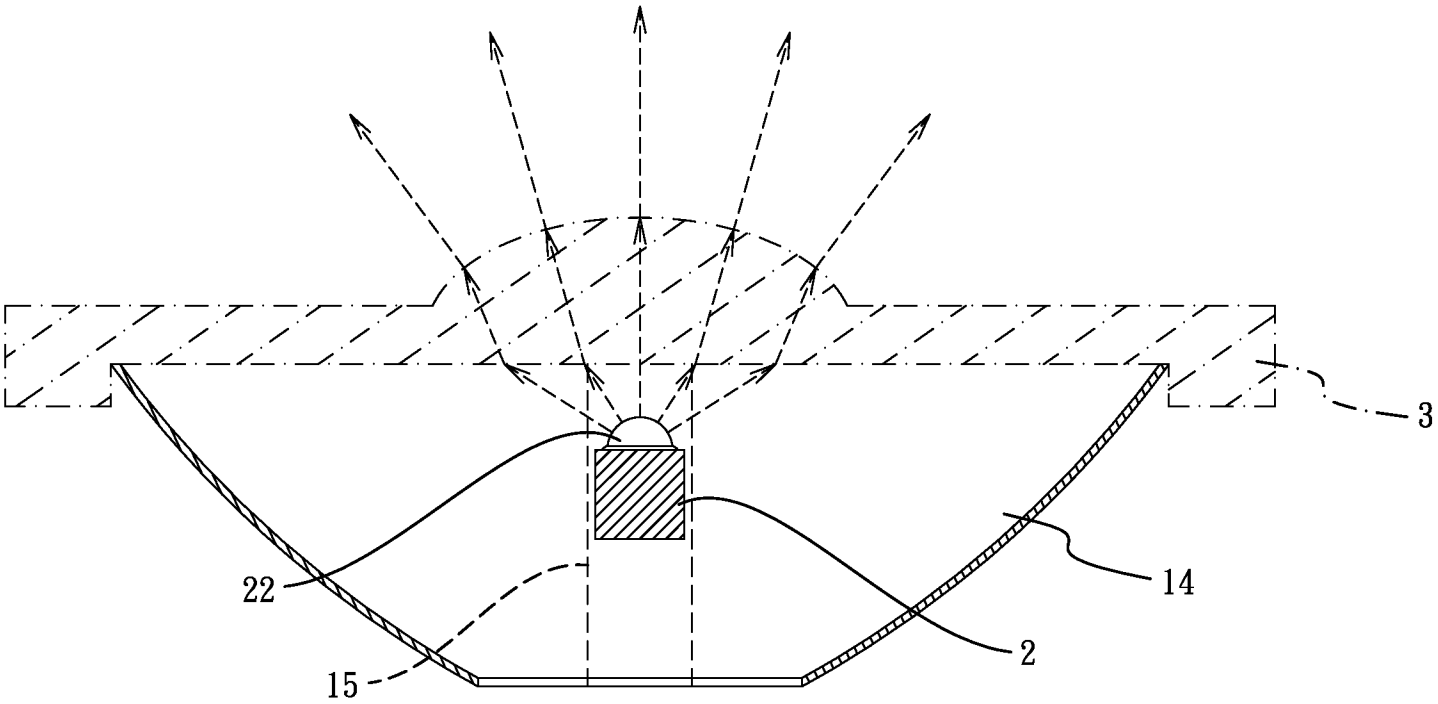
FIG. 4 is a cross-sectional view along the line BB of FIG. 2 for showing the light beams to be diffusing.

Referring to FIG. 4, when the light source 22 moves toward the lens 3 which is above the light emitting opening 11 until the light source 22 reaches the top of the receiving space 14, the light beams from the light source 22 are only refracted by the lens 3. Finally, the light beams pass through the lens 3 to the air and the light beams are diffused by the lens 3.

Referring to FIGS. 1-4, the heat pipe 21 of the aluminum base 2 in the receiving space 14 is extended away from the aluminum base 2 horizontally with an adaptive distance, and then the heat pipe 21 is bent toward the bottom of the receiving space 14 with another adaptive distance (as shown in FIGS. 1-4). Under this arrangement, the heat generated by the light source 22 is conducted to the aluminum base 2, and then the heat is transferred to the heat pipe 21 from the aluminum base 2. Therefore, the heat generated by the light source 22 is dissipated away from the reflecting body 1 to prevent form the damage caused by high temperature and to maintain the good light performance, especially for a LED light source.

Figure 5:
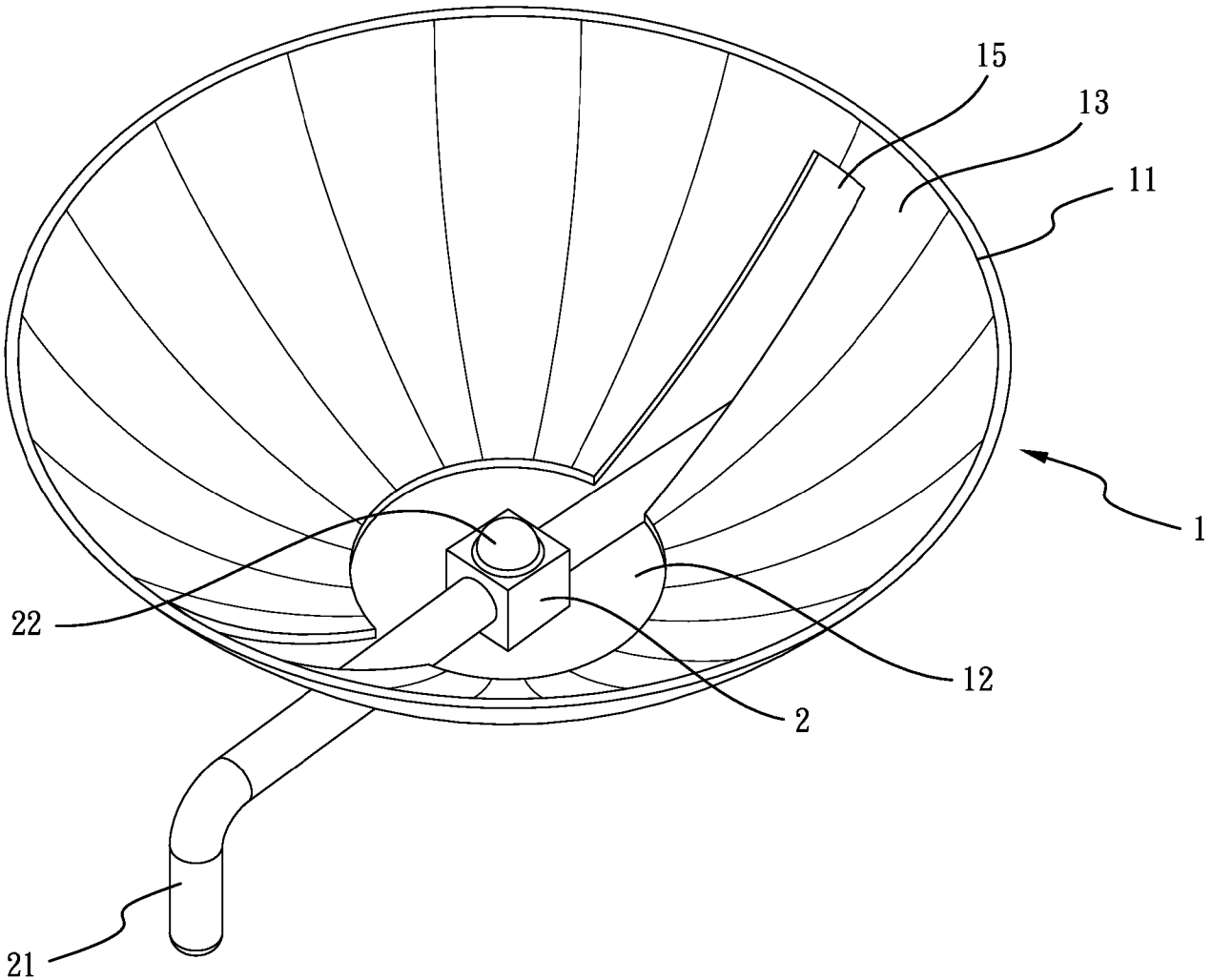
FIG. 5 is a perspective view for showing the second embodiment of the present invention.
Figure 6:
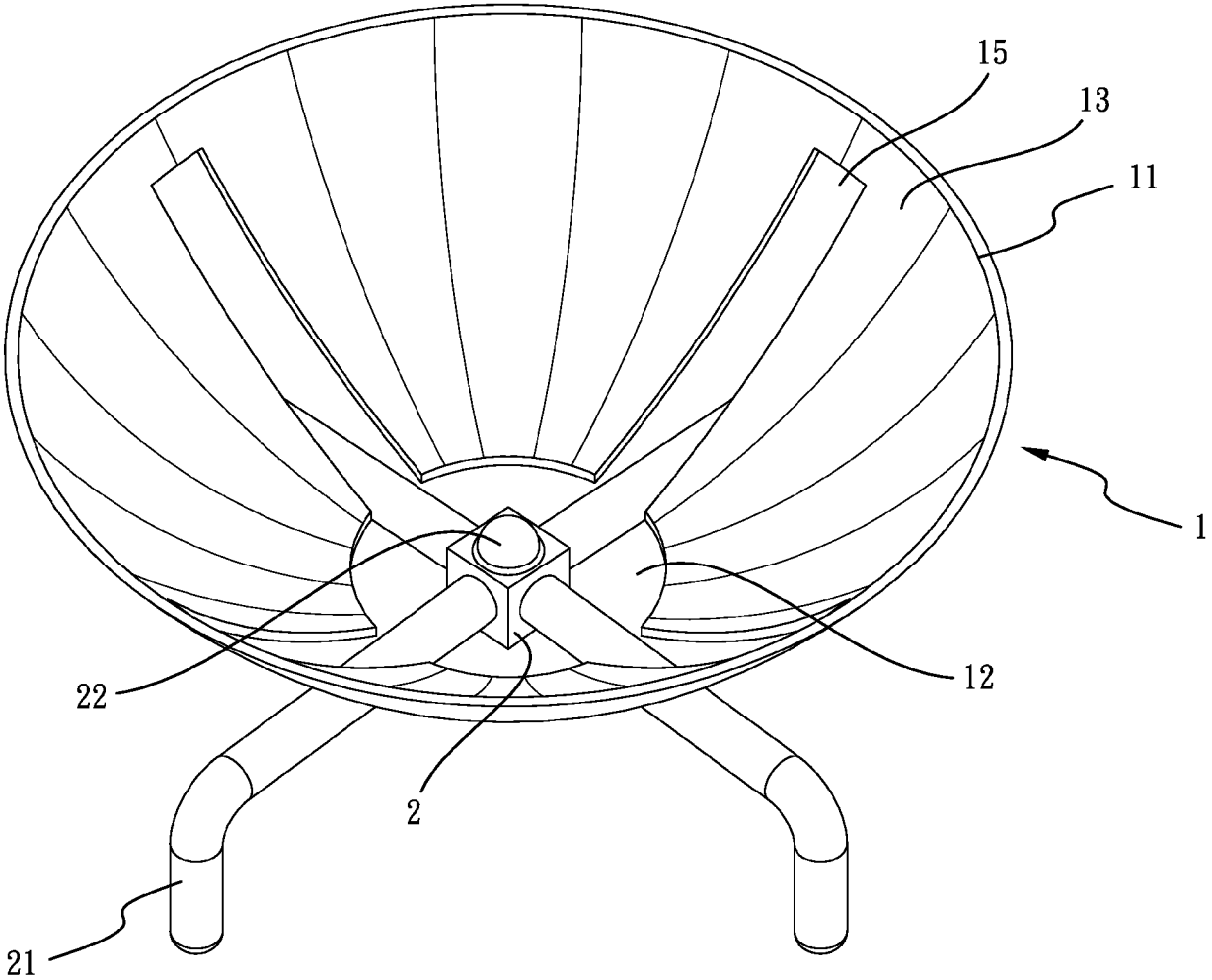
FIG. 6 is a perspective view for showing the third embodiment of the present invention.
Figure 9:
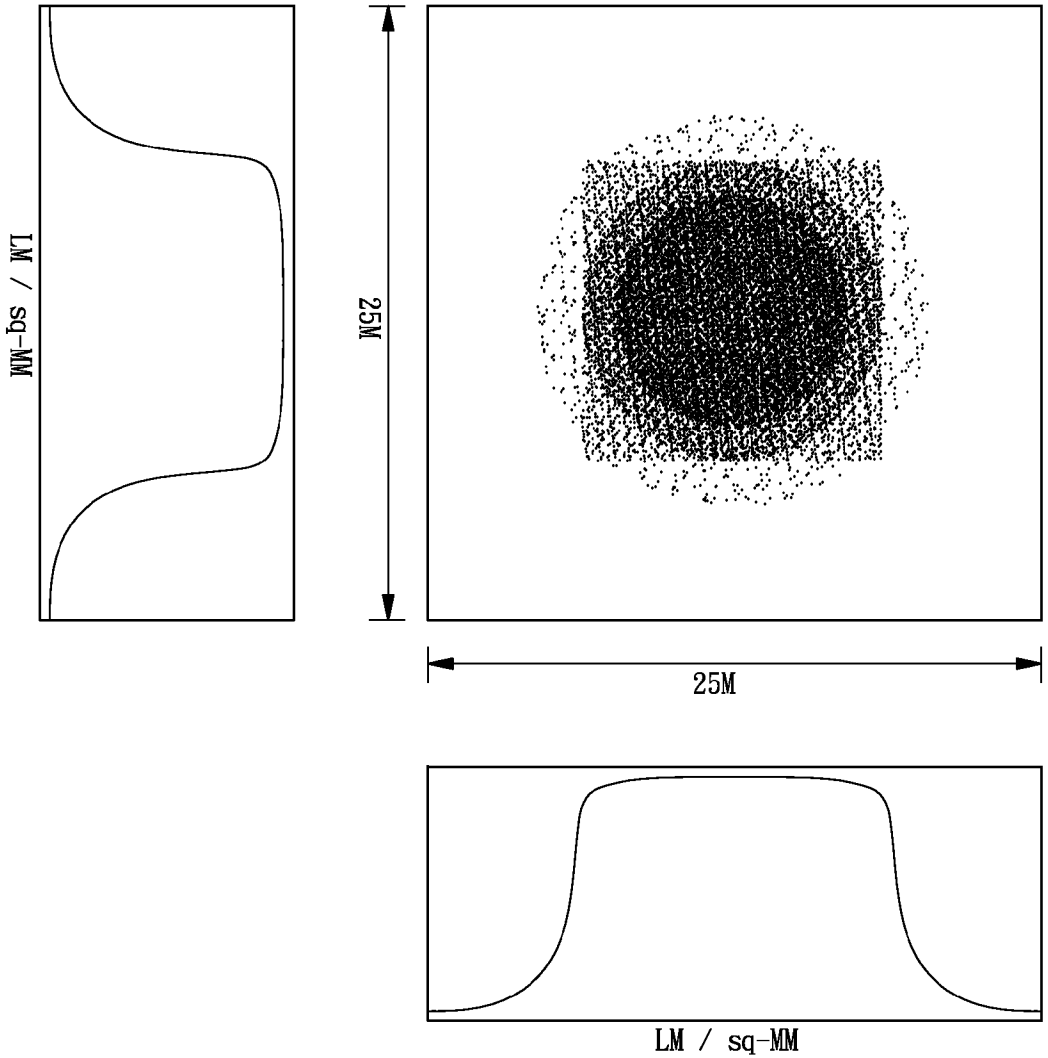
FIGS. 9-11 show three experimental diagrams of the illuminations which are respectively corresponding to the first embodiment, the second embodiment and the third embodiment.
Figure 10:
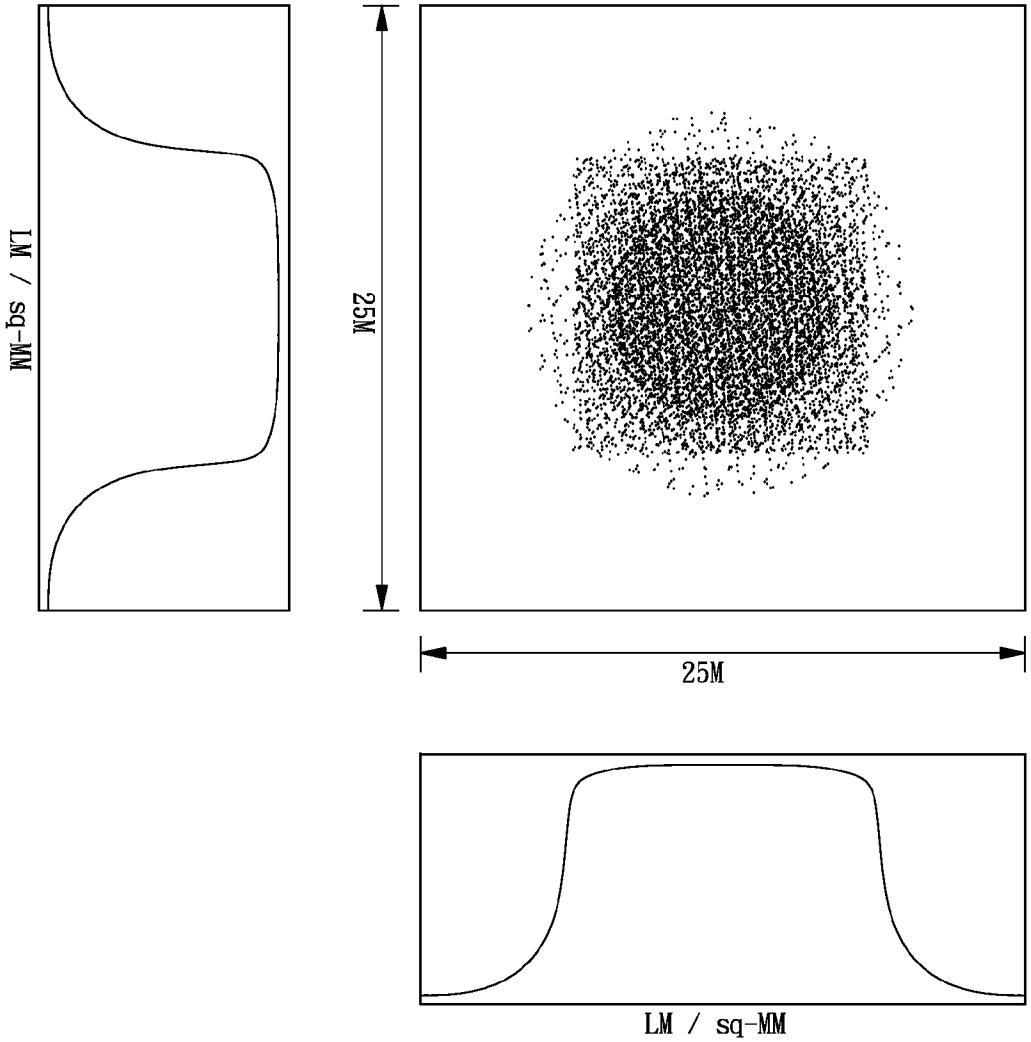
Figure 11:
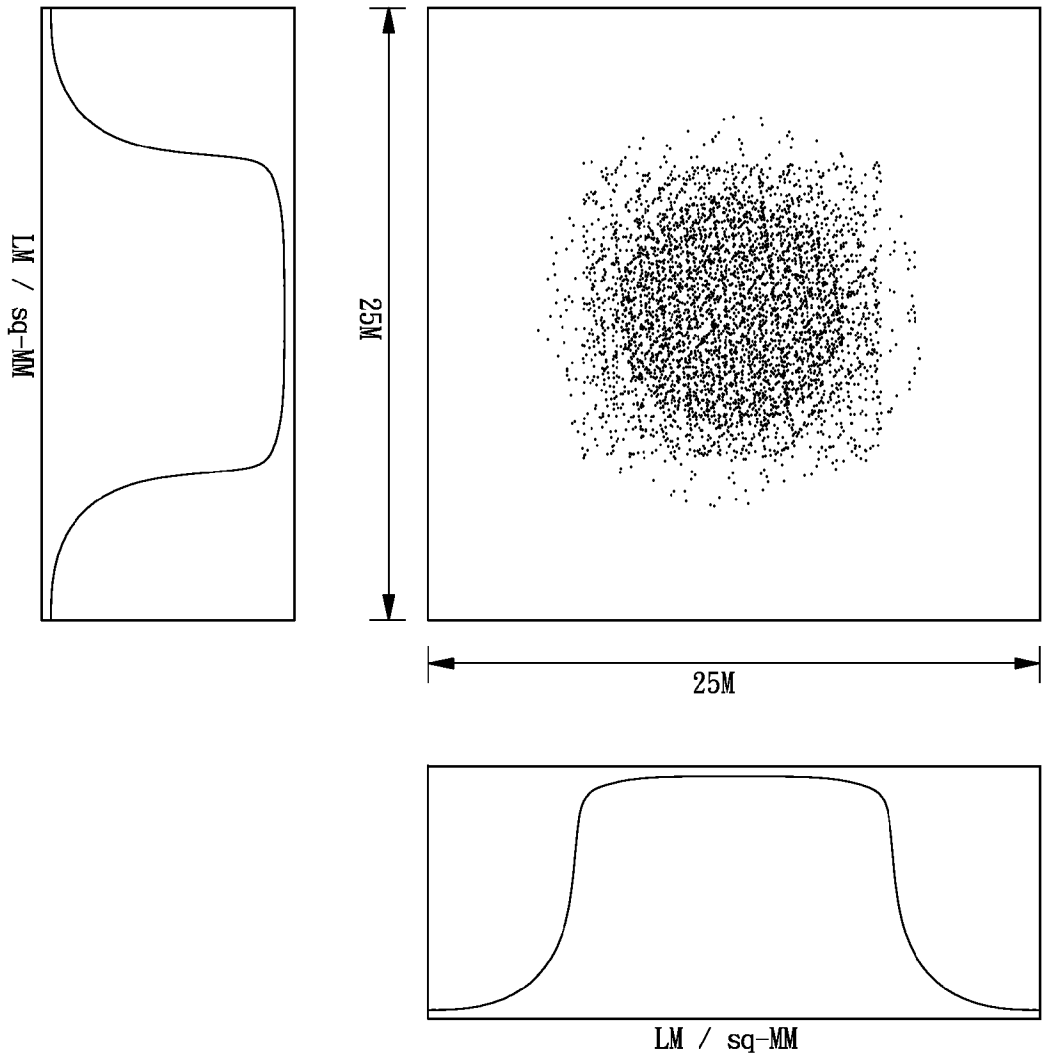

Referring to FIGS. 1 and 9 (which is the first embodiment), FIGS. 5 and 10 (which is the second embodiment) and FIGS. 6 and 11 (which is the third embodiment) respectively, the first embodiment shows that one slot 15 is corresponding to one heat pipe 21 at the receiving body 1; the second embodiment shows that two slots 15 are corresponding to two heat pipes 21 at the receiving body 1; the third embodiment shows that four slots 15 are corresponding to four heat pipes 21 at the receiving body 1. Referring to FIGS. 9-11, the experimental diagrams of illuminations disclose that the illumination would decrease if the amount of the slots 15 is increased (as shown in the first embodiment to the third embodiment). However, the illumination corresponding to the third embodiment (90 lux) is just 10% loss relative to the first embodiment (100 lux) so that the decrease of the illumination is not obvious when the amount of the slot 15 increases. Under this disclosure, the amount of the heat pipes 21 corresponding to the third embodiment is more than the amounts of the heat pipes 21 corresponding to the second embodiment and the first embodiment so that the heat-dissipating effect corresponding to the third embodiment is better than the heat-dissipating effects corresponding to the second and first embodiment, even if the illumination corresponding to the third embodiment is a little less than the illumination corresponding to the first embodiment. Therefore, when the light source 22 is the LED light source, a manufacture could select the third embodiment with the better heat-dissipating effect because how to prevent form the influence caused by high temperature is an important issue for the LED light source.

Figure 7:
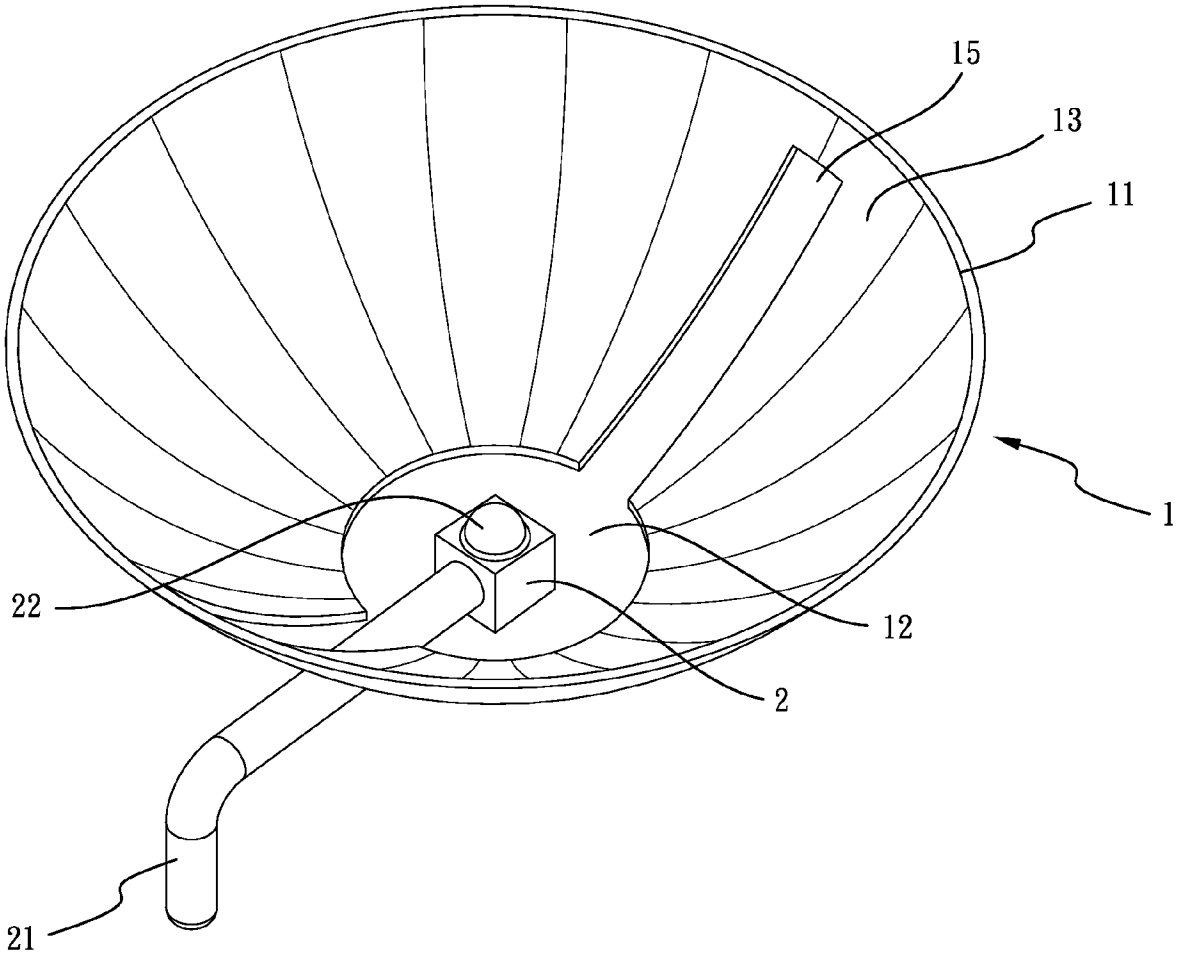
FIG. 7 is a perspective view for showing the fourth embodiment of the present invention.

Referring to FIG. 7, the fourth embodiment is shown as following. The amount of the slots 15 is more than the amount of the heat pipe 21. The fourth embodiment shows two slots 15 corresponding to one heat pipe 21.

Figure 8:
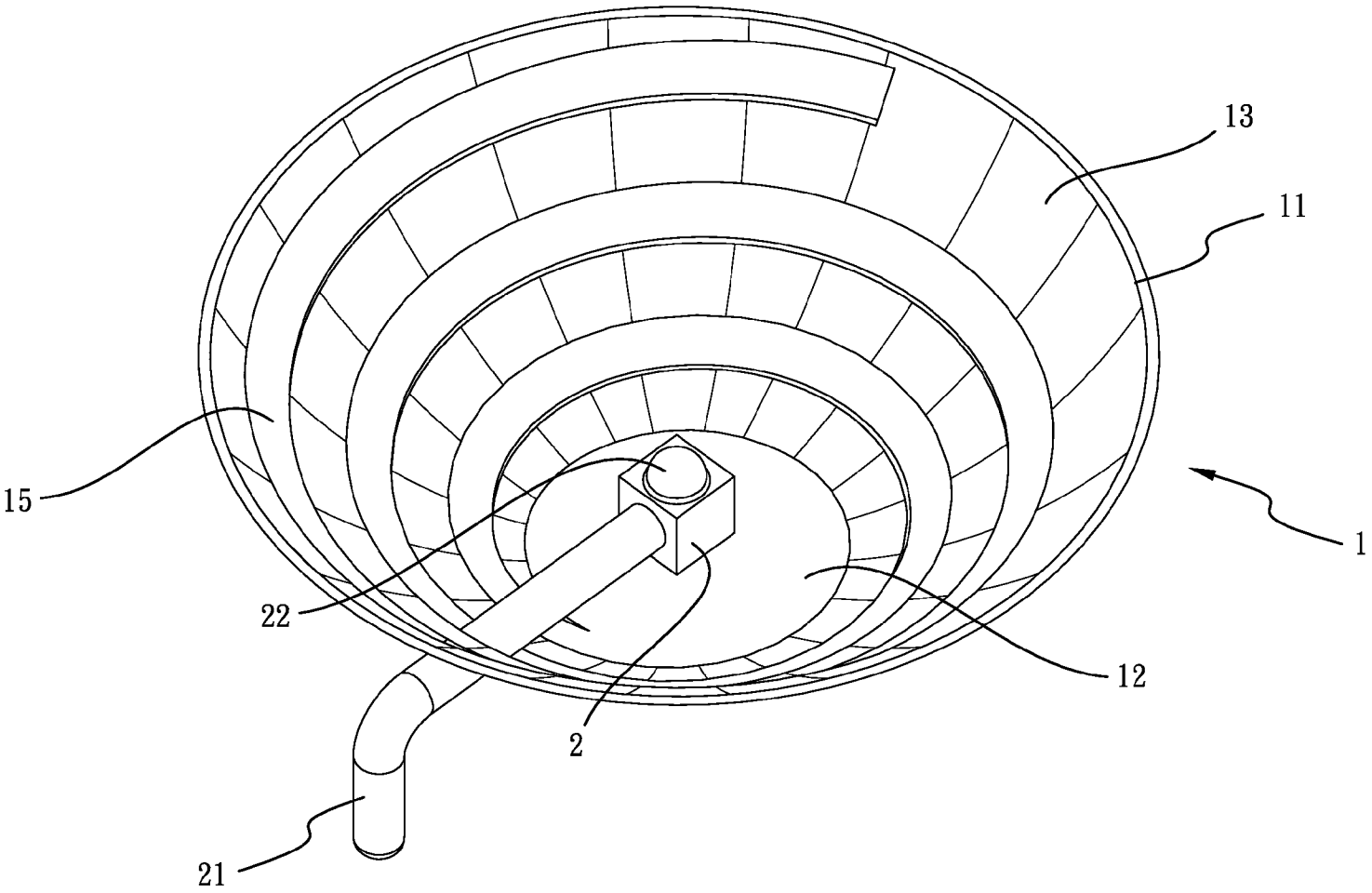
FIG. 8 is a perspective view for showing the fifth embodiment of the present invention.

Referring to FIG. 8, the fifth embodiment is shown as following. At least one spiral slot 15 on the cone surface 13 is opened from the bottom opening 12 to the top opening 11. Under this arrangement, the heat pipe 21 moves along the slot 15 spirally so that the light source 22 on the aluminum base 2 could move toward the lens 3 or move away from the lens 3 with the motion of the heat pipe 21 for diffusing light or focusing light.

Although the invention has been explained in relation to its preferred embodiment, it is to be understood that many other possible modifications and variations can be made without departing from the spirit and scope of the invention as hereinafter claimed.

What is claimed is:

1. An illuminator arrangement with less heat intervention comprising:

a reflecting body having a top opening opened at one end thereof and having a bottom opening opened at another end thereof, a lens assembled above the top opening, a cone surface formed between the top opening and the bottom opening at the reflecting body, a receiving space defined between the top opening, the bottom opening and the cone surface, at least one slot opened along the cone surface; and an aluminum base assembled at the bottom opening, at least one heat pipe extended from the periphery of the aluminum base, the heat pipe being corresponding to the slot, a light source assembled on the top of the aluminum base and movable in the receiving space, the heat pipe being made of the material which is a good heat conductor;

wherein the aluminum base moves up and down relative to the top opening and the heat pipe moves up and down along the slot with the motion of the aluminum base, so that the light source on the aluminum base moves toward the lens or moves away from the lens so as to diffuse light or focus light.

2. The illuminator arrangement with less heat intervention as claimed in claim 1, wherein the size of the aluminum base is smaller than the size of the bottom opening.

3. The illuminator arrangement with less heat intervention as claimed in claim 1, wherein the amount of the heat pipe is the same from the amount of the slot such as one slot corresponding to one heat pipe at the receiving body, two slots corresponding to two heat pipes and four slots corresponding to four heat pipes at the receiving body; or the amount of the slots is more than the amount of the heat pipe.

4. The illuminator arrangement with less heat intervention as claimed in claim 1, wherein at least one spiral slot on the cone surface is opened from the bottom opening to the top opening.

5. The illuminator arrangement with less heat intervention as claimed in claim 1, wherein the heat pipe of the aluminum base in the receiving space is extended away from the aluminum base horizontally with an adaptive distance, and then the heat pipe is bent toward the bottom of the receiving space with another adaptive distance.

* * * * *